United States Patent [19]

Bowles

[11] 4,434,688

[45] Mar. 6, 1984

[54] SCREWDRIVER

[76] Inventor: Corwin Bowles, 795 E. 980 South, Salt Lake County, Utah 84107

[21] Appl. No.: 328,371

[22] Filed: Dec. 7, 1981

[51] Int. Cl.[3] ..... B25B 15/00
[52] U.S. Cl. ..... 81/451
[58] Field of Search ..... 81/451, 436

[56] References Cited

U.S. PATENT DOCUMENTS

| | | | |
|---|---|---|---|
| 1,009,248 | 11/1911 | Jenkins | 81/451 |
| 1,686,681 | 10/1928 | Canode | 81/451 |
| 2,637,229 | 5/1953 | Lee | 81/451 |
| 2,782,822 | 2/1957 | Clark | 81/451 |
| 2,794,462 | 6/1957 | Frykman | 81/451 |
| 3,135,306 | 6/1964 | Mangerian | 81/451 |
| 3,608,596 | 9/1971 | Yoho | 81/451 |
| 4,285,255 | 8/1981 | Winfrey | 81/451 |

FOREIGN PATENT DOCUMENTS

| | | | |
|---|---|---|---|
| 125105 | 8/1947 | Australia | 81/451 |
| 83169 | 11/1919 | Switzerland | 81/451 |
| 700536 | 12/1953 | United Kingdom | 81/451 |

*Primary Examiner*—Frederick R. Schmidt
*Assistant Examiner*—J. T. Zatarga
*Attorney, Agent, or Firm*—Mallinckrodt & Mallinckrodt

[57] ABSTRACT

An improved screwdriver that will not slip out of a screw head, having a screw head receiving element secured to a screwdriver shank. The screw head receiving element is provided with a screwdriver blade and is adapted to receive at least a portion of a screw head of an appropriately sized screw such that the blade can slide in a screw head slot only until said screw head rests against a surface of the screw head receiving element. Preferably, the blade utilized has parallel faces instead of the normally tapered faces of a standard screwdriver so that the inside edges of the screw head slot are not damaged during use of the screwdriver.

5 Claims, 10 Drawing Figures

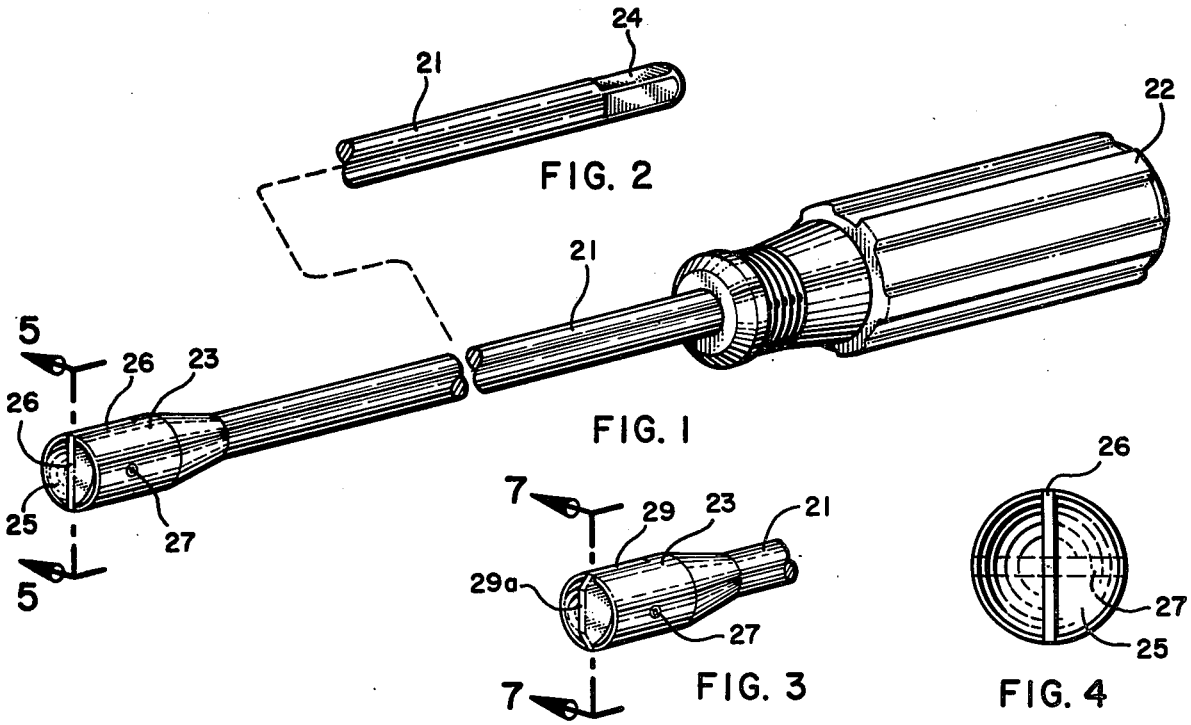
FIG. 2
FIG. 1
FIG. 3
FIG. 4
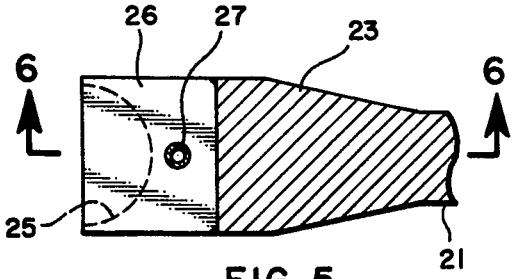
FIG. 5
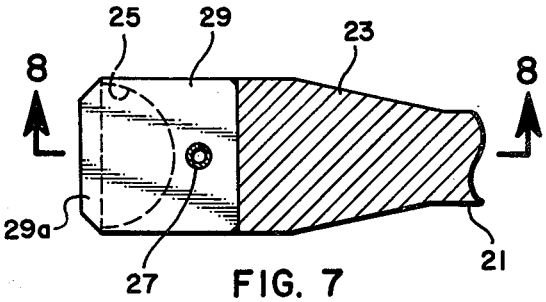
FIG. 7
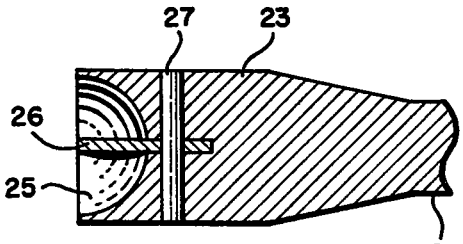
FIG. 6
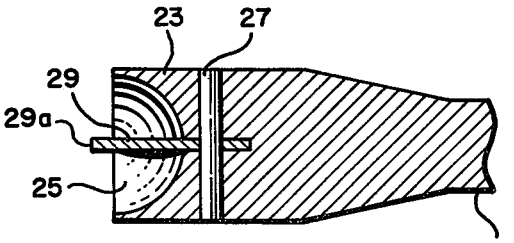
FIG. 8
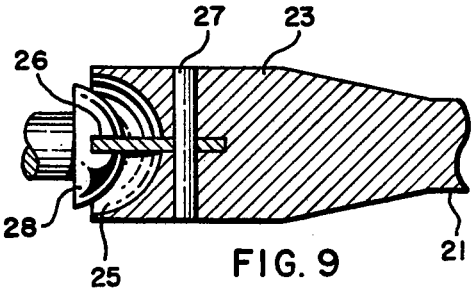
FIG. 9
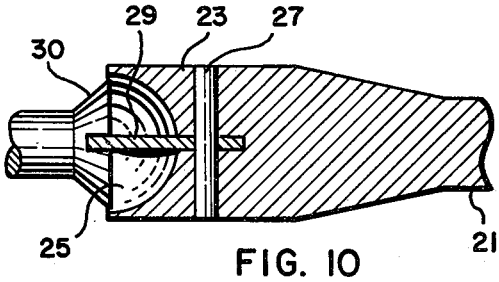
FIG. 10

SCREWDRIVER

BACKGROUND OF THE INVENTION

1. Field

The invention is in the field of screwdrivers, and particularly relates to screwdrivers adapted so as not to slip off of a screw.

2. State of the Art

Various devices have been constructed for use in connection with a standard screwdriver to keep the screwdriver from slipping out of the slot of a screw as the screw is driven. In general, the approach has been to utilize a cylindrical tube which fits around both the screwdriver blade and the head of a screw, thus holding the screwdriver in position.

Although this type of device is useful in preventing a screwdriver from slipping off the edge of a screw, it does nothing to alleviate the further problem of using a standard screwdriver blade having tapered faces, wherein such a blade tends to damage the inside edges of the slot of a screw head. Thus, it would be desirable to avoid the disadvantages of using screwdriver blades having tapered faces and yet to have a screwdriver that can be manufactured economically. It would also be desirable to provide a simpler manner of preventing a screwdriver from slipping off of a screw head.

SUMMARY OF THE INVENTION

According to the present invention, an improved screwdriver that will not slip out of the slot of a screw head is constructed by securing a screw head receiving element to a screwdriver shank, and providing the screw head receiving element with a blade.

The preferred embodiment utilizes a blade having parallel faces instead of the normally tapered faces of a standard screwdriver. This is done economically by using a rectangular blade secured within the screw head receiving member by a retainer pin.

THE DRAWING

In the accompanying drawing, which represents the best mode presently contemplated for carrying out the invention:

FIG. 1 is a perspective view of an improved screwdriver constructed according to the invention, a portion of the screwdriver shank being broken away for convenience of illustration;

FIG. 2, a fragmentary perspective view of the end of the shank adapted for securement to a screwdriver handle or other drive means;

FIG. 3, a fragmentary view of the working end of an alternative embodiment adapted for use with flat-head screws;

FIG. 4, an end view of the screwdriver shown in FIG. 1, and drawn to a larger scale;

FIG. 5, a fragmentary longitudinal section taken, and drawn to a larger scale along the line 5—5 of FIG. 1;

FIG. 6, a section taken along the line 6—6 of FIG. 5;

FIG. 7, a fragmentary longitudinal section taken along the line 7—7 of FIG. 3, and drawn to a larger scale;

FIG. 8, a section taken along the line 8—8 of FIG. 7;

FIG. 9, a view similar to FIG. 6 but showing a round-headed screw in working position; and FIG. 10, a view similar to FIG. 8 but showing a flat-headed screw in working position.

DETAILED DESCRIPTION OF THE ILLUSTRATED EMBODIMENT

The presently preferred embodiment of the invention is illustrated in FIG. 1. A shank 21 is provided with a handle 22 on one end and a screw head receiving element 23 on the other end. Optionally, the handle end of shank 21 may be adapted as at 24 for use with a ratchet assembly, a power drive unit, or the like. It might also be desirable to adapt the screw head receiving element to receive a removable shank (not shown).

The screw head receiving element 23 is conveniently formed from a cylindrical section of metal having a diameter somewhat larger than the screw head of the screw with which the screwdriver is to be used, and bored out on the working end so as to form a substantially hemispherical concavity 25 of a size which will accept the screw head. The actual shape and size of the concavity can be determined easily by one of ordinary skill in the art after considering what screws a particular screw head receiving element is to be used with.

A slot (not shown) is cut longitudinally along the axis of screw head receiving member 23 to a depth several millimeters past the concavity and having a width appropriate for accepting a blade 26. Blade 26 is a rectangular plate having parallel faces and a thickness slightly less than the width of the slot of the screw with which it will be used, a width substantially equal to the diameter of screw head receiving member 23, and a height substantially equal to the depth of the slot cut into the screw head receiving member. Thus, blade 26 may be slid into place such that it bisects the concavity and fits flush with the side and working end of the screw head receiving member.

A hole (not shown) is bored through screw head receiving member 23 on a line perpendicular to the plane of the slot. A matching hole is bored through blade 26 so that a pin 27 may be driven through the holes in both the screw head receiving member and the blade, and thus hold blade 26 securely in place. If for any reason blade 26 should need to be replaced, pin 27 may be removed.

In use, the screwdriver is placed in working contact with the head of a screw 28 as shown in FIG. 9. Such a screw head may be of any diameter and shape which fits within concavity 25. As the screwdriver is turned, there is a tendency for blade 26 to slide sideways within the slot of slot of screw head 28. A standard screwdriver could slide all of the way out of the slot. However, when using the present invention, the blade can only slide until the screw head rests against the wall of concavity 25.

The invention is also useful to drive flat-headed screws. For this purpose, however, it is desirable to substitute a blade 29 having a tapered extension **29*a* for rectangular blade 26. The angle of taper and width of extension 29*a* should be such that a flat head screw 30 fits on blade extension 29*a* with only a small portion of the screw head extending into concavity 25. None of the blade should extend beyond the edges of screw head 30** so that the blade will not mar the surface into which the screw is being driven.

Whereas the invention is here illustrated and described with specific reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. An improved screwdriver comprising a shank, one end of said shank having a screw head receiving means including a screw head receiving cavity adapted to receive at least a portion of the head of a screw to be driven to thereby prevent lateral motion of the shank with respect to the screw head, the other end of the shank being adapted to have drive means secured thereto; a blade means receiving slot in said screw head receiving means extending beyond the screw head receiving cavity; blade means adapted to removably slip into the blade means receiving slot and be held therein against rotational movement relative to the shank and in position so that a portion of the blade extends across the screw head receiving cavity to thereby mate with the slot of a screw head inserted into the cavity; a hole extending through the screw head receiving means and the blade means perpendicular to the blade means receiving slot, the ends of such hole being visable on opposite sides of the screw head receiving means and visable to a user of the screwdriver so as to show the orientation of the blade means within the screw head receiving cavity; and pin means removably secured in said hole to hold said blade means in position.

2. A screwdriver according to claim 1, wherein the end of the shank opposite the end to which the screw head receiving means is secured is adapted to be removably secured to a drive means.

3. A screwdriver according to claim 1, wherein the screw head receiving means is provided with a substantially hemispherical concavity for receiving screw heads.

4. A screwdriver according to claims 1 or 3, wherein the blade means has parallel faces.

5. A screwdriver according to claim 1, wherein the working end of the blade means is substantially flush with the receiving end of the screw head receiving means.

* * * * *